US005174416A

United States Patent [19]

Sakabe et al.

[11] Patent Number: 5,174,416

[45] Date of Patent: Dec. 29, 1992

[54] LINEAR INDUCTION MOTOR FOR ELEVATOR

[75] Inventors: Shigekazu Sakabe, Amagasaki; Takehiko Kubota, Inazawa; Kazuhiko Sugita, Inazawa; Toshiaki Ishii, Inazawa; Hiroyuki Ikejima, Inazawa, all of Japan

[73] Assignee: Mitsubishi Denki Kabushika Kaisha, Tokyo, Japan

[21] Appl. No.: 827,510

[22] Filed: Jan. 29, 1992

Related U.S. Application Data

[63] Continuation of Ser. No. 758,397, Sep. 4, 1991, abandoned, which is a continuation of Ser. No. 644,623, Jan. 23, 1991, abandoned.

[30] Foreign Application Priority Data

Jan. 25, 1990 [JP] Japan ..... 2-13652

[51] Int. Cl.[5] ..... B66B 11/04

[52] U.S. Cl. ..... 187/17; 310/12; 104/292; 104/294

[58] Field of Search ..... 187/17, 94, 95; 310/12, 310/190, 191, 192, 193, 154; 318/135; 104/292, 294; 198/619

[56] References Cited

U.S. PATENT DOCUMENTS 3,820,472 6/1974 Schwärzler ..... 104/294
4,570,753 2/1986 Ohta et al. ..... 187/94 X
5,005,672 4/1991 Nakai et al. ..... 187/17

FOREIGN PATENT DOCUMENTS 62-92760 4/1987 Japan .

*Primary Examiner*—Robert P. Olszewski
*Assistant Examiner*—Dean A. Reichard
*Attorney, Agent, or Firm*—Leydigt, Voit & Mayer

[57] ABSTRACT

A linear induction motor for an elevator which includes a secondary, stationary element having a body formed with a plurality of iron-core mounting holes arranged longitudinally of the body at a certain interval, and iron cores disposed in the holes. The stationary, secondary element allows magnetic flux flowing therethrough to pass through the iron cores, thereby reducing the dimension of the total magnetic gap in the motor. Furthermore, the combination of the iron cores in which eddy currents flow with difficulty and the body along which eddy currents tend to flow makes it possible to reduce the ineffective eddy currents.

6 Claims, 4 Drawing Sheets

LINEAR INDUCTION MOTOR FOR ELEVATOR

This application is a continuation of application Ser. No. 07/758,397 now abandoned, filed Sep. 4, 1991 which is a continuation of application Ser. No. 07/644,623 now abandoned, filed Jan. 23, 1991.

BACKGROUND OF THE INVENTION

1. Field of the Invention

The present invention relates to a linear induction motor for an elevator and, more specifically, to a linear induction motor for an elevator which is used as an apparatus for driving the elevator.

2. Description of the Related Art

Hitherto, elevators employing linear induction motors as driving apparatuses have been disclosed, for instance, in Japanese Patent Laid-Open No. 57-121568.

FIG. 5 shows the structure of a conventional linear induction motor for an elevator which is of the flat-element two-sided induction type, and which is the same as that shown in "Linear Motors and Their Application" (pages 14 to 27; published by Japanese Electrotechnical Committee (JEC) in March 1984). Referring to FIG. 5, a secondary, stationary element 1 made of aluminum and having a thickness of t is provided in an elevator shaft (not shown) in such a manner as to vertically extend. A primary, movable element 2 comprising primary iron cores 2*a* and windings (not shown) wound thereon is provided on a counter-weight (not shown) which is vertically movable along the secondary, stationary element 1. The movable element 2 has two mutually opposing portions between which portions the stationary element 1 is positioned. Although in FIG. 5, these portions of the movable element 2 are shown as separate parts on either side of the stationary element 1, they are in fact parts of a single member that are integral with each other. Gaps 3 and 4, each having a dimension of g, are defined between two opposing surfaces of the secondary, stationary element 1 and the two portions of the primary, movable element 2.

In the conventional linear induction motor for an elevator which has the above-described construction, when alternating current is supplied to the windings of the primary, movable element 2, magnetic flux, such as the flux 5 indicated by the arrows, is generated by the corkscrew rule. The magnetic flux 5 moves progressively. On the other hand, the magnetic flux 5 causes eddy currents, such as the currents 6 shown in FIG. 6, to flow in the secondary, stationary element 1. The magnetic flux 5 and the eddy currents 6 together allow a thrust to be produced in accordance with Fleming's rule, whereby the primary, movable element 2 is driven.

At this time, the dimension of the total magnetic gap in the linear induction motor corresponds to the result obtained by adding, to the sum of the respective dimensions g of the gaps 3 and 4, the thickness t of the secondary, stationary element 1, in other words, $2g+t$.

The above-described construction of the conventional linear induction motor for an elevator entails the following problem. Since the secondary, stationary element 1 whose length is determined by the length of elevator shaft can be considerably long, it is difficult to keep the element 1 straight throughout the length thereof with a high level of precision. On the other hand, if the dimension g of the gaps 3 and 4 are extremely small, there is a risk that the primary movable element 2 may contact the secondary, stationary element 1. In order to avoid this risk, the dimension g of the gaps 3 and 4 cannot be reduced to an extreme degree. For this reason, it has been difficult to reduce the dimension of the total magnetic gap in the linear induction motor. Furthermore, since the secondary, stationary member 1 consists of a single conductor made of aluminum, this construction inevitably involves ineffective eddy currents, such as the currents 7 indicated by the broken lines in FIG. 6, which flow in the stationary element 1 in vain because these currents do not serve to produce thrust. Because of the total magnetic gap that cannot easily be reduced and because of the ineffective eddy currents, the conventional linear induction motor for an elevator suffers from a problem in which the driving efficiency cannot be substantially increased.

SUMMARY OF THE INVENTION

Accordingly, an object of the present invention is to provide a linear induction motor for an elevator which allows the total magnetic gap to be substantially reduced, and which also allows the ineffective current to be reduced, thereby enabling an improvement in the driving efficiency.

In order to achieve the above object, according to the present invention, there is provided a linear induction motor for an elevator comprising: a secondary, stationary element provided in an elevator shaft in such a manner as to vertically extend, the secondary, stationary element having a stationary element body which is made of a non-magnetic conductor and which has a plurality of iron-core mounting holes formed therein and arranged longitudinally thereof at a certain interval, and iron cores disposed in the iron-core mounting holes and made of a magnetic substance having an electric resistance which is greater than that of the stationary element body; and a primary, movable element provided in opposition to the secondary, stationary element and capable of vertical movement for causing the vertical movement of an elevator car.

DESCRIPTION OF THE PREFERRED EMBODIMENTS

Figure 1:
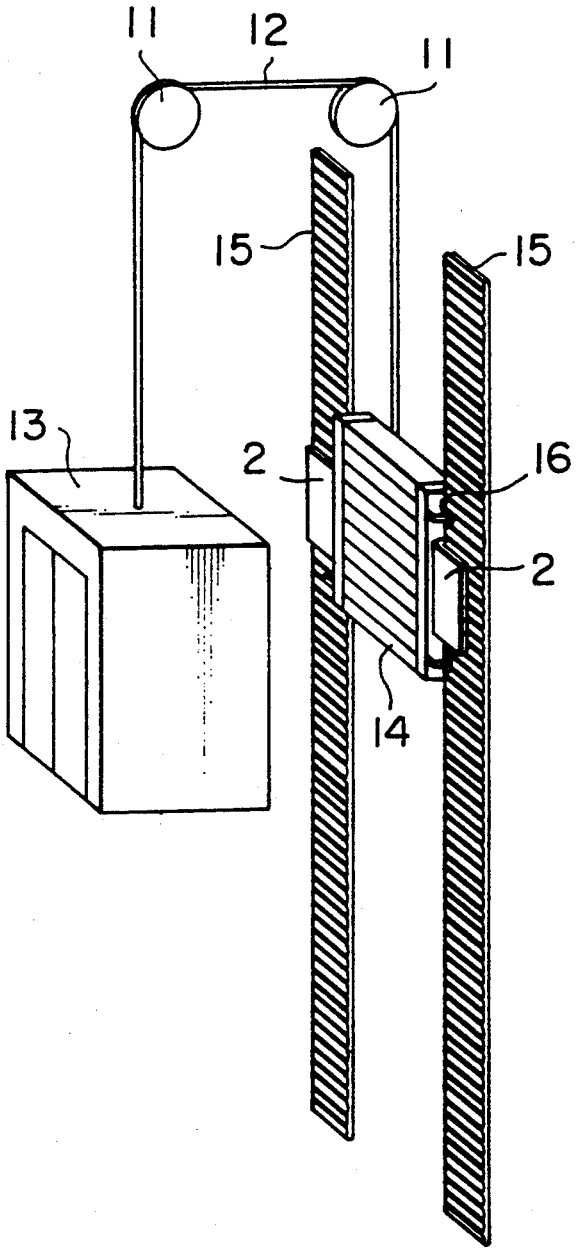
FIG. 1 is a perspective view of the essential parts of an elevator in which a linear induction motor for an elevator according to one embodiment of the present invention is employed.
Figure 2:
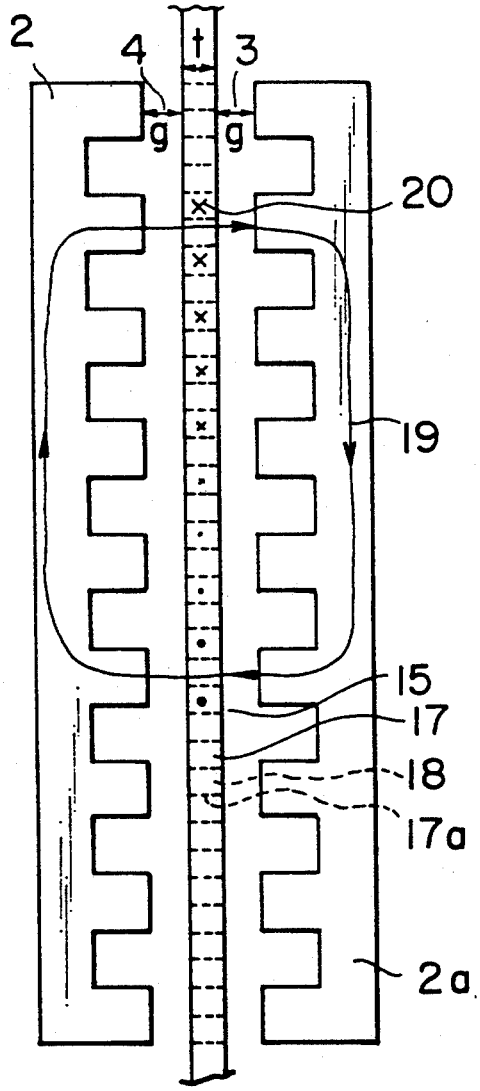
FIG. 2 is a view showing the structure of the linear induction motor shown in FIG. 1.
Figure 5:
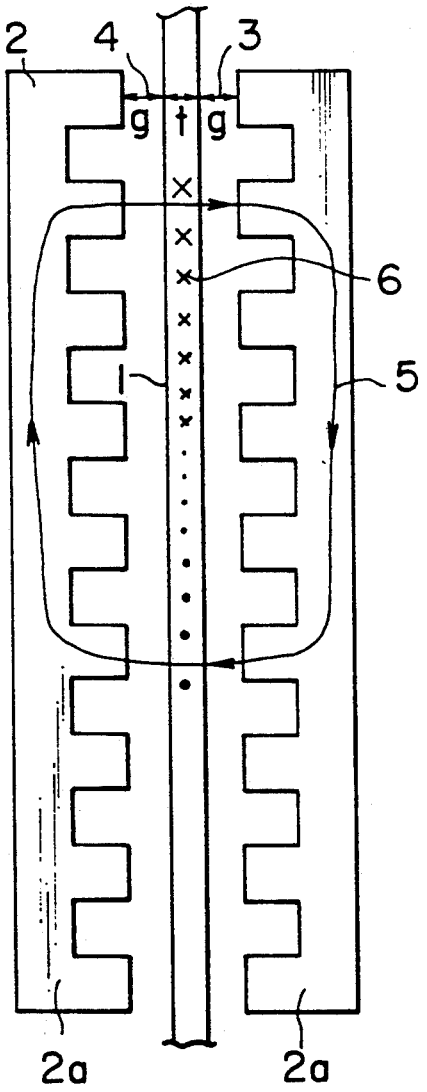
FIG. 5 PRIOR ART
FIG. 5 is a view showing the structure of a conventional linear induction motor for an elevator.

The preferred embodiments of the present invention will now be described with reference to the drawings. FIG. 1 shows, in a perspective view, the essential parts of an elevator incorporating a linear induction motor for an elevator according to an embodiment of the present invention. FIG. 2 shows the structure of the motor shown in FIG. 1. In these drawings, component parts which are the same as or correspond to those shown in FIG. 5 are designated by the same reference numerals, and the description of these component parts will be omitted.

Referring to FIG. 1, two pulleys 11 are provided on a ceiling portion of an elevator shaft (not shown). A rope 12 is wound on the pulleys 11. An elevator car 13 is fixed to one end of the rope 12, while a counter-weight 14 is fixed to the other. A pair of secondary, stationary elements 15, having a thickness of t, are provided in parallel to each other in the elevator shaft, in such a manner as to vertically extend.

A pair of primary, movable elements 2, which are each similar to the known movable element, are provided on either lateral side of the counter-weight 14 in such a manner that each of the secondary, stationary elements 15 is positioned between the forward and backward portions (only the forward portion is shown in FIG. 1) of the corresponding primary, movable element 2. Also provided on the counter-weight 14 are guide shoes 16 for sliding on the secondary, stationary elements 15. As shown in FIG. 2, gaps 3 and 4, having a dimension g which is substantially the same as that in the known construction, are defined between each of the secondary, stationary elements 15 and the forward and backward portions of the corresponding primary, movable element 2.

Referring to FIG. 2, each secondary, stationary element 15 comprises a stationary element body 17 having a plurality of slits 17*a* serving as iron-core mounting holes, and iron cores 18 disposed in the slits 17*a*. The slits 17*a* are formed in the stationary element body 17 and are arranged in the longitudinal direction of the body 17 at a certain interval. Each of the slits 17*a* is elongated widthwise of the stationary element 15, and is deep through the full thickness of the element 15. The stationary element body 17 is made of a non-magnetic conductor such as aluminum. The iron cores 18 are made of a magnetic substance having an electric resistance which is greater than that of the material (e.g., aluminum) forming the body 17. The dimension of the interval of the slits 17*a* which is measured longitudinally of the body 17 is an integer times the dimension of the iron cores 18 which is measured in the same direction.

Figure 3:
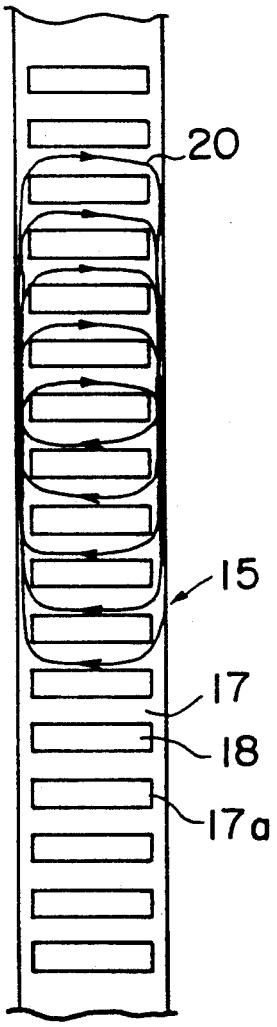
FIG. 3 is a front view of a secondary, stationary element of the motor shown in FIG. 2.

Next, operation will be described. When alternating current is supplied to the windings of the primary, movable elements 2, magnetic flux 19 (indicated by the arrows in FIG. 2) is generated in accordance with the corkscrew rule. The magnetic flux 19 causes eddy currents 20 (shown in FIG. 3) to flow in the secondary, stationary elements 15. The magnetic flux 19 and the eddy currents 20 together allow a thrust to be produced, whereby the primary, movable elements 2 are driven.

In this process, since the magnetic flux flowing through each secondary, stationary element 15 passes through the iron cores 18, this makes it possible to reduce that part of the magnetic gap resulting from the thickness t of the secondary, stationary element 15 to the extent that the part of the magnetic gap is substantially negligible. Consequently, the total magnetic gap in the linear induction motor substantially solely results from the gaps 3 and 4 between the elements 15 and 2, and substantially corresponds to the sum 2g of the respective dimensions of the gaps 3 and 4. Therefore, the total magnetic gap in the motor is considerably smaller than that in the conventional motor.

Figure 6:
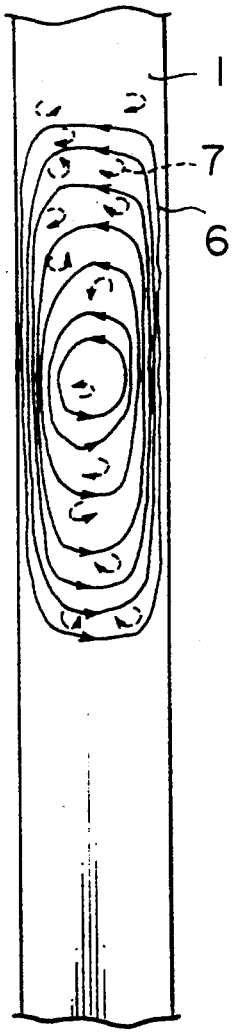
FIG. 6 PRIOR ART
FIG. 6 is a front view of a secondary, stationary element of the conventional motor.

Furthermore, the eddy currents 20 do not easily flow in the iron cores 18 but tend to flow along the stationary element body 17 having a smaller electric resistance than the iron cores 18. Because the flow of eddy currents tends to be concentrated on the stationary element body 17 and occur along the body 17, this results in a corresponding reduction in the area where ineffective eddy currents (such as the currents 7 shown in FIG. 6, which do not serve to produce thrust) may flow. Thus, the amount of ineffective currents in random flows is considerably reduced from the corresponding amount in the conventional motor.

For these reasons, the linear induction motor for an elevator according to the embodiment of the present invention is able to achieve a higher driving efficiency than the conventional motor.

Figure 4:
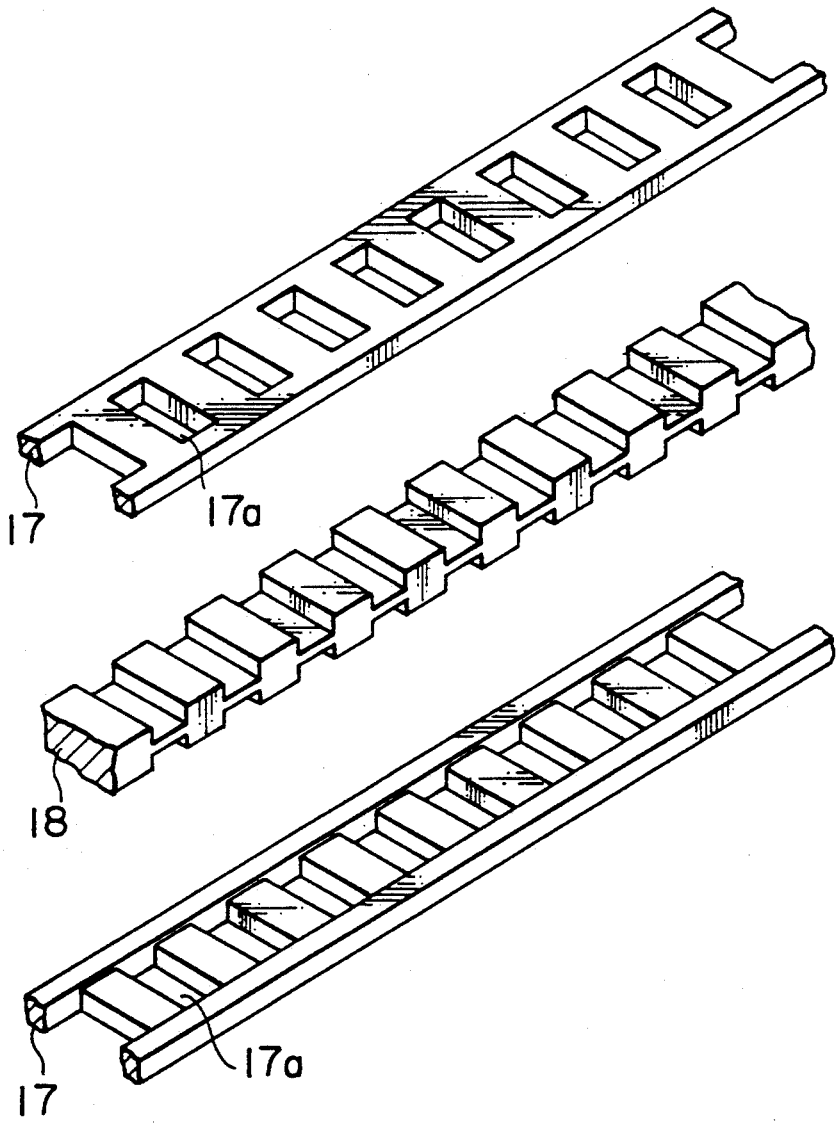
FIG. 4 is fragmentary, exploded perspective view of a secondary, stationary element of a linear induction motor for an elevator according to another embodiment of the present invention.

Although in this embodiment, each of the secondary, stationary elements 15 of the embodiment has the stationary element body 17 formed with the plurality of slits 17*a*, and the iron cores 18 disposed in the slits 17*a*, the present invention is not intended to be limited thereto. In another embodiment, each secondary, stationary element has, as shown in FIG. 4, a stationary element body 17 which is divided into a first part (shown in FIG. 4A) and a second part (shown in FIG. 4C), and iron cores 18 which are integrated together. This arrangement makes the assembly of the secondary, stationary element 15 easier than that in the first embodiment.

Although in the above-described embodiment the stationary element body 17 is made of aluminum, the body 17 may be made of another non-magnetic conductor, such as copper.

Further, although in the above-described embodiment the iron core mounting holes in each stationary element body 17 consist of the slits 17*a* which are formed completely through the thickness of the stationary element body 17, it is not necessary that the mounting holes be formed completely through the body 17. The iron cores 18 may be exposed on at least one surface of the stationary element body 17 which faces the movable element. Alternatively, the iron cores 18 may be disposed inside the stationary element body 17. These alternative arrangements, which are advantageous in that the total magnetic gap is reduced by the amount corresponding to the thickness of the iron cores, and that eddy currents flow in the iron cores with difficulty, provide effect accordingly. Further, the sectional configuration of the iron-core mounting holes, etc., may be other than those adopted in the embodiments described above.

Still further, although the above-described embodiment shows the primary, movable elements 2 which are provided on the counter-weight 14, the present invention is also applicable to a linear induction motor for an elevator which has primary, movable elements provided on an elevator car.

As described above, according to the present invention, the magnetic flux flowing through the secondary, stationary elements passes through the iron cores, thereby enabling the total magnetic gap in the motor to be substantially reduced by an amount corresponding to the thickness of the iron cores. Furthermore, eddy currents flow along the stationary element bodies having a relatively small electric resistance, thereby reducing the area where ineffective eddy currents, which do not serve to produce thrust, may flow, hence, reducing the ineffective eddy currents. For these reasons, it is possible to improve the driving efficiency of the motor.

What is claimed is:

1. A linear induction motor for an elevator comprising:

a stationary secondary element provided in an elevator shaft in such a manner as to extend vertically, the secondary element having a stationary element body of a non-magnetic conductor and a plurality of iron-core mounting holes formed therein and arranged longitudinally thereof at a certain interval, and iron cores disposed in the iron-core mounting holes which are of a magnetic substance having an electric resistance greater than that of the stationary element body; and a movable primary element adjacent the secondary element and mounted for vertical movement for causing the vertical movement of an elevator car, the primary element having forward and backward portions spaced from the secondary element, the secondary element being positioned between the forward and backward portions of the primary element whereby magnetic flux generated between the forward and backward portions of the primary element flows through the iron cores of the secondary element, and eddy currents caused thereby are concentrated in the non-magnetic conductor body of the secondary element.

2. A motor as claimed in claim 1 wherein the iron cores of the secondary element are spaced equidistantly from the forward and backward portions of the primary element.

3. A motor as claimed in claim 1 wherein the iron cores of a magnetic substance are exposed on one surface of the non-magnetic conductor body of the secondary element and are spaced from both the forward and backward portions of the primary element.

4. A motor as claimed in claim 1 wherein the iron cores of a magnetic substance are disposed inside the stationary secondary element body of a non-magnetic conductor.

5. A motor as claimed in claim 1 wherein the longitudinal dimension of the interval of the iron-core mounting holes formed in the stationary secondary element body is an integer times the longitudinal dimension of the iron cores disposed therein.

6. A motor as claimed in claim 1 wherein the iron cores of the stationary secondary element comprise iron core members disposed in at least two adjacent ones of the mounting holes and integrated with each other.

* * * * *